US005374228A

United States Patent [19]

Buisman et al.

[11] Patent Number: 5,374,228

[45] Date of Patent: Dec. 20, 1994

[54] DOWNHILL SKIING EXERCISE MACHINE

[75] Inventors: Stanley R. Buisman, Brooklyn Park; Timothy S. Engel, Mound, both of Minn.

[73] Assignee: NordicTrack, Inc., Chaska, Minn.

[21] Appl. No.: 892,173

[22] Filed: Jun. 2, 1992

[51] Int. Cl.[5] ..... A63B 69/18

[52] U.S. Cl. ..... 482/71; 482/51

[58] Field of Search ..... 482/71, 51, 70

[56] References Cited

U.S. PATENT DOCUMENTS

| | | | |
|---|---|---|---|
| 2,274,081 | 2/1942 | Mautin | 272/57 |
| 3,408,067 | 10/1968 | Armstrong | 272/16 |
| 3,455,550 | 7/1969 | Hall | 272/57 |
| 3,462,141 | 8/1969 | Robbins | 482/71 |
| 3,467,374 | 9/1969 | Auer | 272/57 |
| 3,475,021 | 10/1969 | Ruegsegger | 272/57 |
| 3,531,110 | 9/1970 | Marchu | 272/57 |
| 3,575,412 | 4/1971 | Arsenian | 272/57 |
| 3,582,066 | 6/1971 | Keryluk | 272/57 |
| 3,591,172 | 7/1971 | Hude | 272/57 |
| 3,650,528 | 3/1972 | Natterer | 272/57 B |
| 3,708,163 | 1/1973 | Hynes | 272/57 B |
| 3,807,727 | 4/1974 | Ferguson | 482/71 |
| 3,856,321 | 12/1974 | Solymosi | 482/71 |
| 3,874,656 | 4/1975 | Wintersteller | 272/79 R |
| 4,396,189 | 8/1983 | Jenkins | 272/97 |
| 4,429,869 | 2/1984 | Eckstein | 272/97 |
| 4,595,195 | 6/1986 | Miehlich | 272/97 |
| 4,607,839 | 8/1986 | Knudson | 272/97 |
| 4,645,202 | 2/1987 | Tomba et al. | 482/71 |
| 4,669,723 | 6/1987 | Arsenian | 482/70 |
| 4,678,183 | 7/1987 | Skovajsa | 272/97 |
| 4,730,826 | 3/1988 | Sudmeier | 272/65 |
| 4,743,014 | 5/1988 | Loane | 272/97 |
| 4,744,557 | 5/1988 | Smirmaul | 272/97 |
| 4,744,558 | 5/1988 | Smirmaul | 272/97 |
| 4,795,146 | 1/1989 | Donnerstag et al. | 482/71 |
| 4,802,856 | 2/1989 | Olson | 434/253 |
| 4,869,496 | 9/1989 | Colombo | 272/97 |
| 4,907,796 | 3/1990 | Roel-Rodriguez | 272/97 |
| 4,909,503 | 3/1990 | Olson | 272/97 |
| 4,911,430 | 3/1990 | Flament | 272/97 |
| 4,953,853 | 9/1990 | Loane | 272/97 |
| 4,953,858 | 9/1990 | Zelli | 272/346 |
| 4,993,704 | 2/1991 | Luczynski | 272/97 |

FOREIGN PATENT DOCUMENTS

| | | | |
|---|---|---|---|
| 2333210 | 1/1973 | Germany . | |
| 0444733 | 2/1968 | Switzerland | 482/71 |
| 673092 | 2/1990 | Switzerland . | |
| 1475694 | 4/1989 | U.S.S.R. | 482/71 |

*Primary Examiner*—Stephen R. Crow

*Attorney, Agent, or Firm*—Merchant, Gould, Smith, Edell, Welter & Schmidt

[57] ABSTRACT

The present invention provides a frame that supports a pair of simulator skis above a floor surface. Rear ski ends are pivotally mounted to a rear ski support in rolling contact with a track surface on a rear frame portion. Front ski ends are pivotally mounted to a front ski support in rolling contact with the floor surface. Non-parallel, equal length bars are disposed on opposite sides of the pair of skis, extending from rear bar ends pivotally mounted to the base to front bar ends pivotally mounted to the front ski support.

25 Claims, 5 Drawing Sheets

DOWNHILL SKIING EXERCISE MACHINE

FIELD OF THE INVENTION

The present invention relates generally to exercise equipment, and more particularly, to an exercise apparatus that simulates downhill skiing.

BACKGROUND OF THE INVENTION

Others have designed exercise equipment intended to function as downhill skiing simulators. However, none of the prior art devices appears to disclose an exercise apparatus that (1) is fun to use; (2) is easy to use; (3) is relatively simple in construction; (4) effectively exercises the muscles used in downhill skiing; and (5) accurately simulates the "feel" of downhill skiing. Some of the particular problems with prior art downhill skiing simulators include difficulty (1) getting on and off the device; (2) learning to use the device; (3) feeling unstable while on the device; (4) performing edging motions; and (5) realizing an accurate downhill skiing sensation. Thus, it is desirable to provide an exercise apparatus that simulates downhill skiing.

SUMMARY OF THE INVENTION

According to one embodiment, the present invention provides a pair of simulator skis supported by a frame that rests upon a floor surface. The skis have front ski ends pivotally mounted to a front ski support, and rear ski ends pivotally mounted to a rear ski support. The front ski support is carried by at least one roller in contact with the floor surface. The rear ski support is carried by at least one roller in contact with a track surface that is supported above the floor surface by a rear frame portion. Non-parallel, equal length bars are disposed on opposite sides of the pair of skis, extending from front bar ends pivotally mounted to the front ski support, to rear bar ends pivotally mounted to the rear frame portion.

The present invention is fun and easy to use and relatively simple in construction. It accurately simulates the "feel" of downhill skiing and provides natural stability and natural edging capability. These and other advantages of the present invention will become apparent upon a more detailed description of the preferred embodiment.

BRIEF DESCRIPTION OF THE DRAWING

Referring to the Figures, wherein like numerals represent like parts throughout the several views.

DETAILED DESCRIPTION OF A PREFERRED EMBODIMENT

Figures 1, 6:
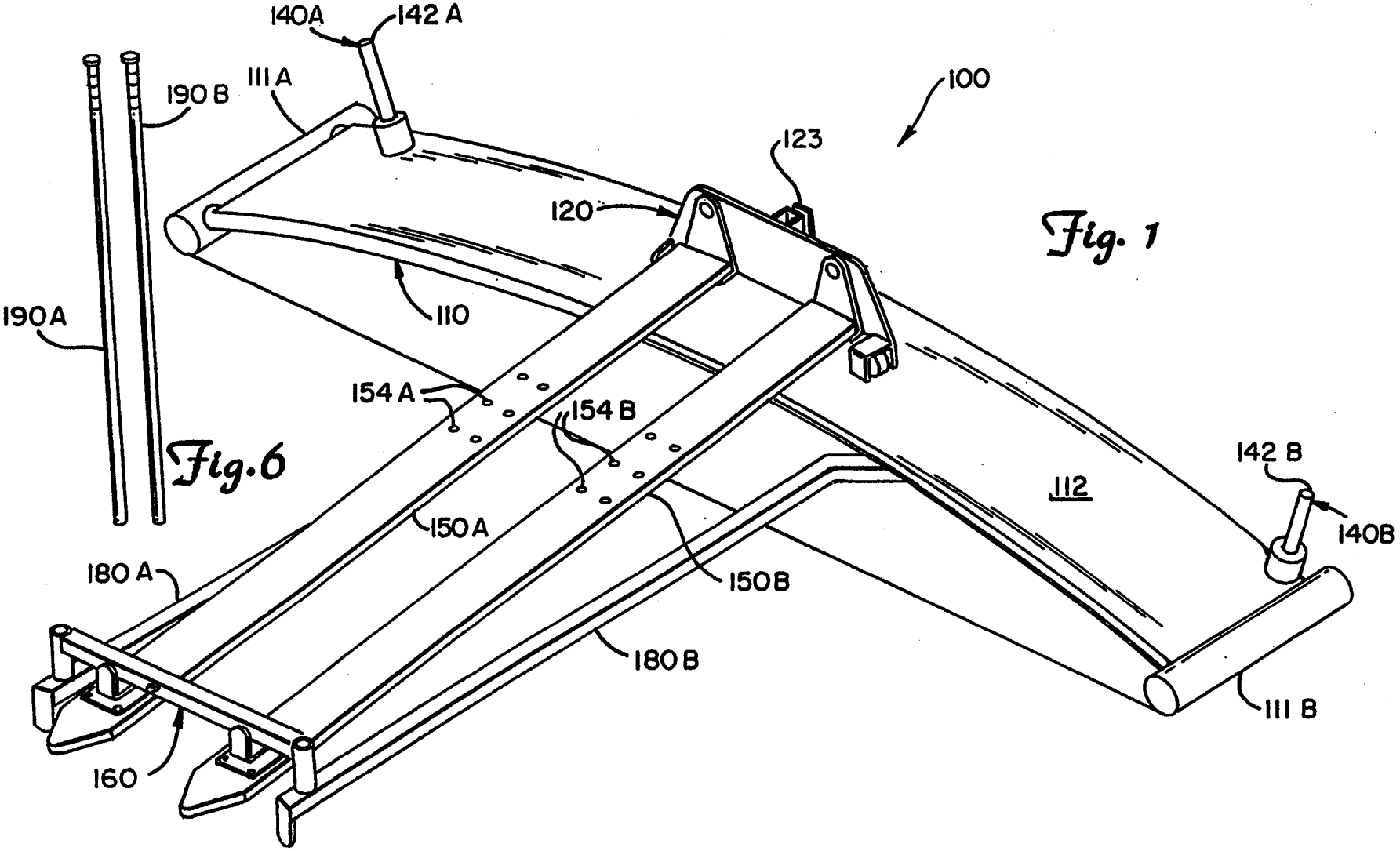
FIG. 1 is a perspective view of an exercise apparatus constructed according to the principles of the present invention.
FIG. 6 is a front view of a pair of simulator ski poles designed for use with the exercise apparatus shown in FIG. 1.
Figure 2:
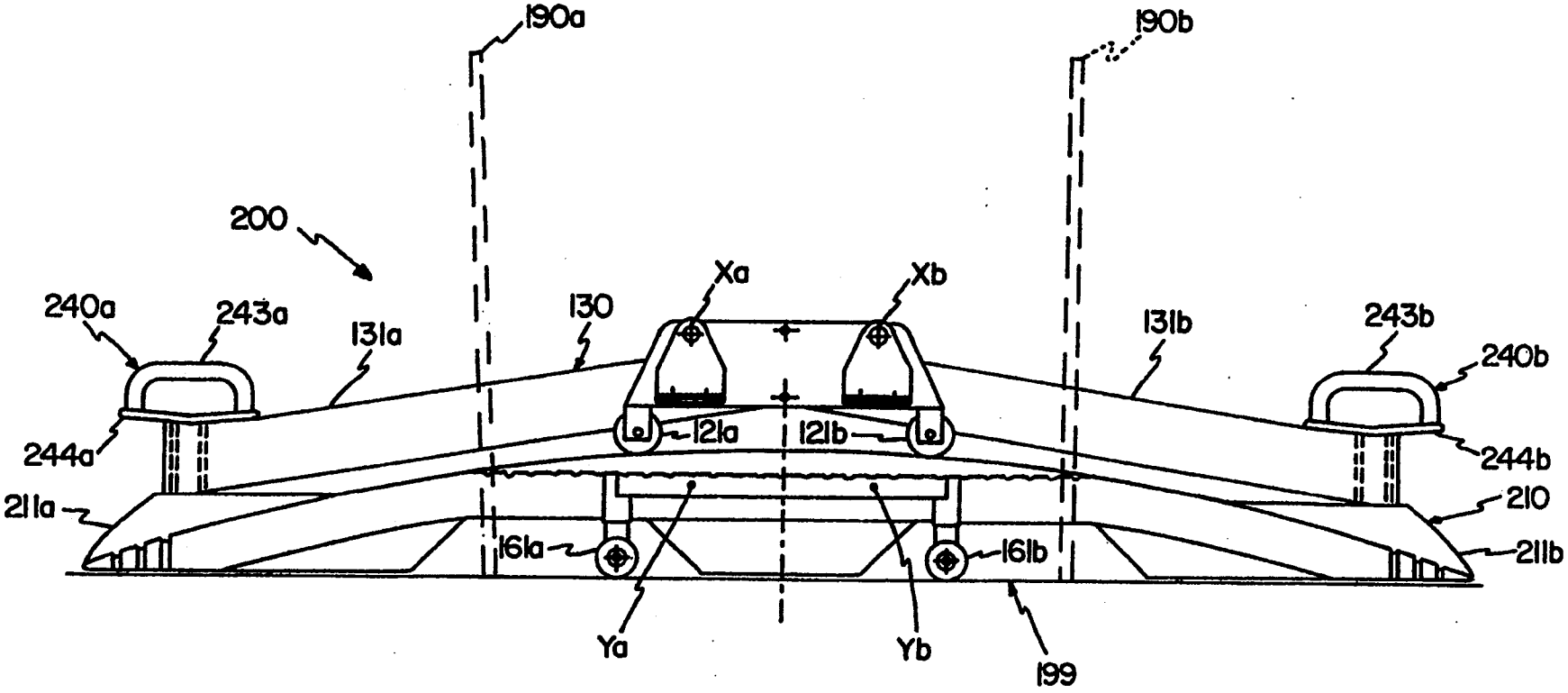
FIG. 2 is a front view of an exercise apparatus similar to that shown in FIG. 1, but with a different base and different band supports.
Figure 4:
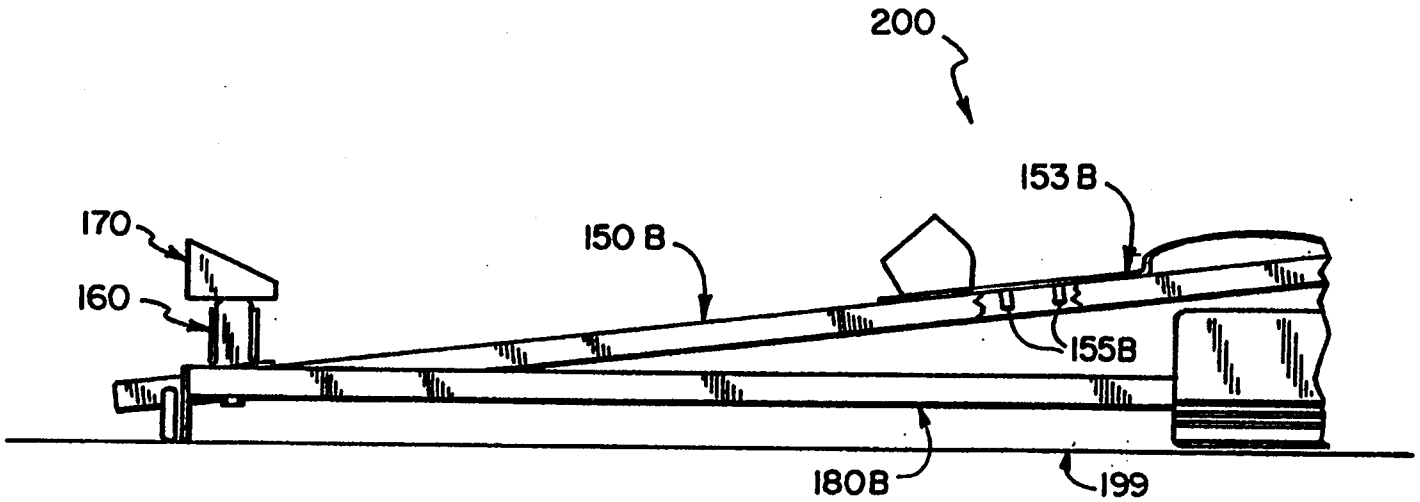
FIG. 4 is a side view of the exercise apparatus shown in FIG. 2.
Figure 5:
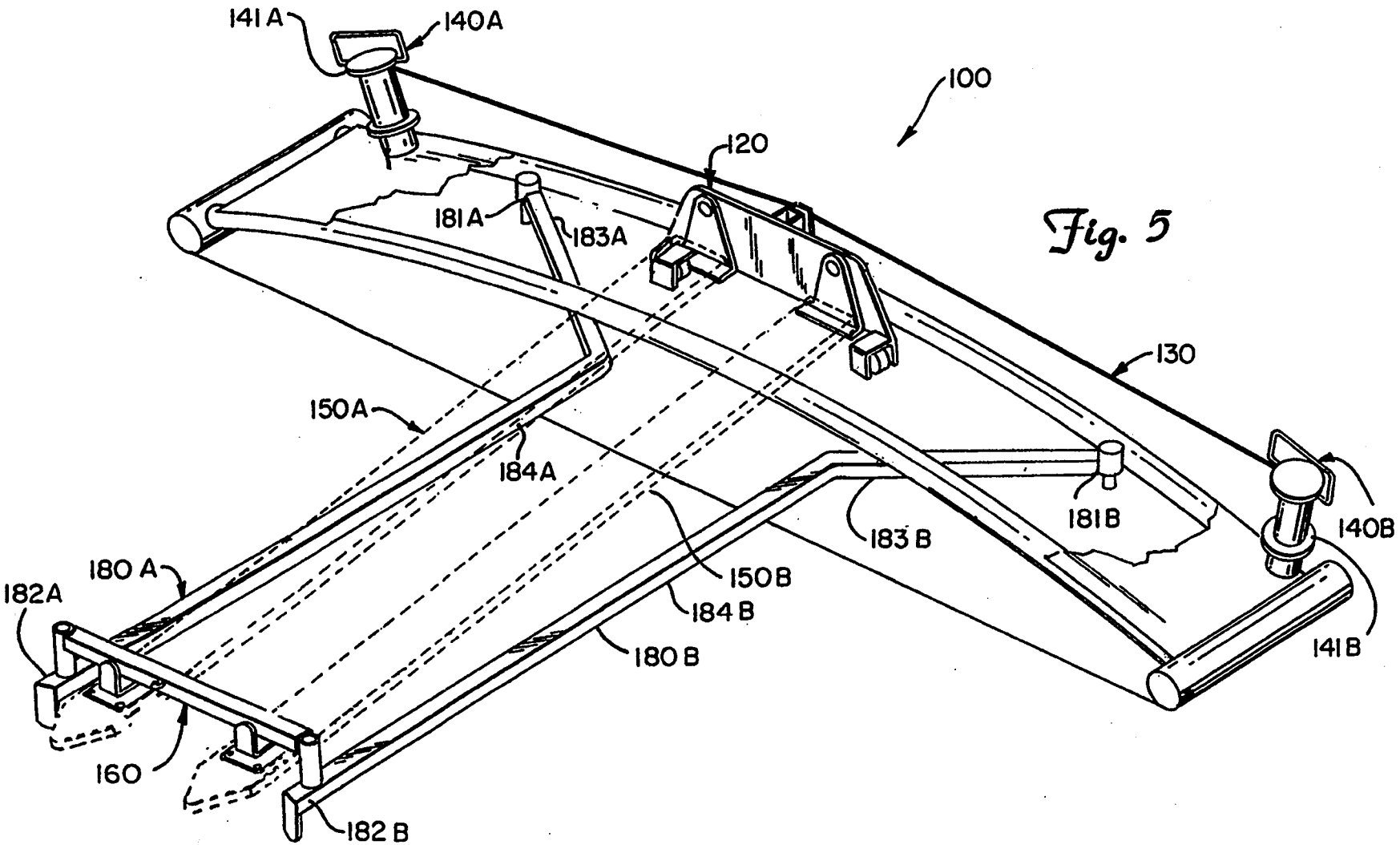
FIG. 5 is another perspective view of the exercise apparatus shown in FIG. 1.

The present invention provides an exercise apparatus (designated at 100 in FIGS. 1 and 5, and 200 in FIGS. 2–4) that rests upon a floor surface 199. As shown in FIGS. 1 and 5, the apparatus generally includes a base 110 (preferred embodiment designated at 210 in FIGS. 2–4), a rear ski support 120, an elastic band 130 (shown in FIGS. 2–3), elastic band supports **140*a* and 140*b* (preferred embodiment designated at 240*a* and 240*b* in FIGS. 2–3), simulator skis 150*a* and 150*b*, a front ski support 160, inertia sensory and data output means 170 (shown in FIGS. 3–4), and bars 180*a* and 180*b*. As shown in FIGS. 2 and 6, simulator poles 190*a* and 190*b*** are also provided for use with the exercise apparatus.

The base 110 extends laterally approximately 63 inches from a first end **111*a* to a second end 111*b*. The base supports a track surface 112 (as high as approximately 7 inches at its zenith) above the floor surface 199. The track surface 112 is a generally cylindrical surface having a radius of curvature of approximately 89 inches. The rear ski support 120 is carried by rear rollers 121*a* and 121*b*, which are in contact with the track surface 112. A marker 213 is positioned on the base 210 to identify a central location on the track surface 112 for convenient reference with respect to the position of the rear ski support 120**.

The elastic band 130 is secured at an intermediate region 132 to a spacer 123 on the rear ski support 120, which effectively divides the elastic band 130 into a first elastic band segment **131*a* and a second elastic band segment 131*b*. The spacer 123 places some distance between the elastic band segments 131*a* and 131*b* and the rear ski support 120 in order to minimize undesirable "flapping" of the band segments against the rear ski support. Also, since the spacer 123 is centered on the rear ski support 120, the alignment of the spacer 123 relative to the marker 213 indicates that the rear ski support 120 is centered on the track surface, an equal distance from each of the band supports 140*a* and 140*b***.

Figure 3:
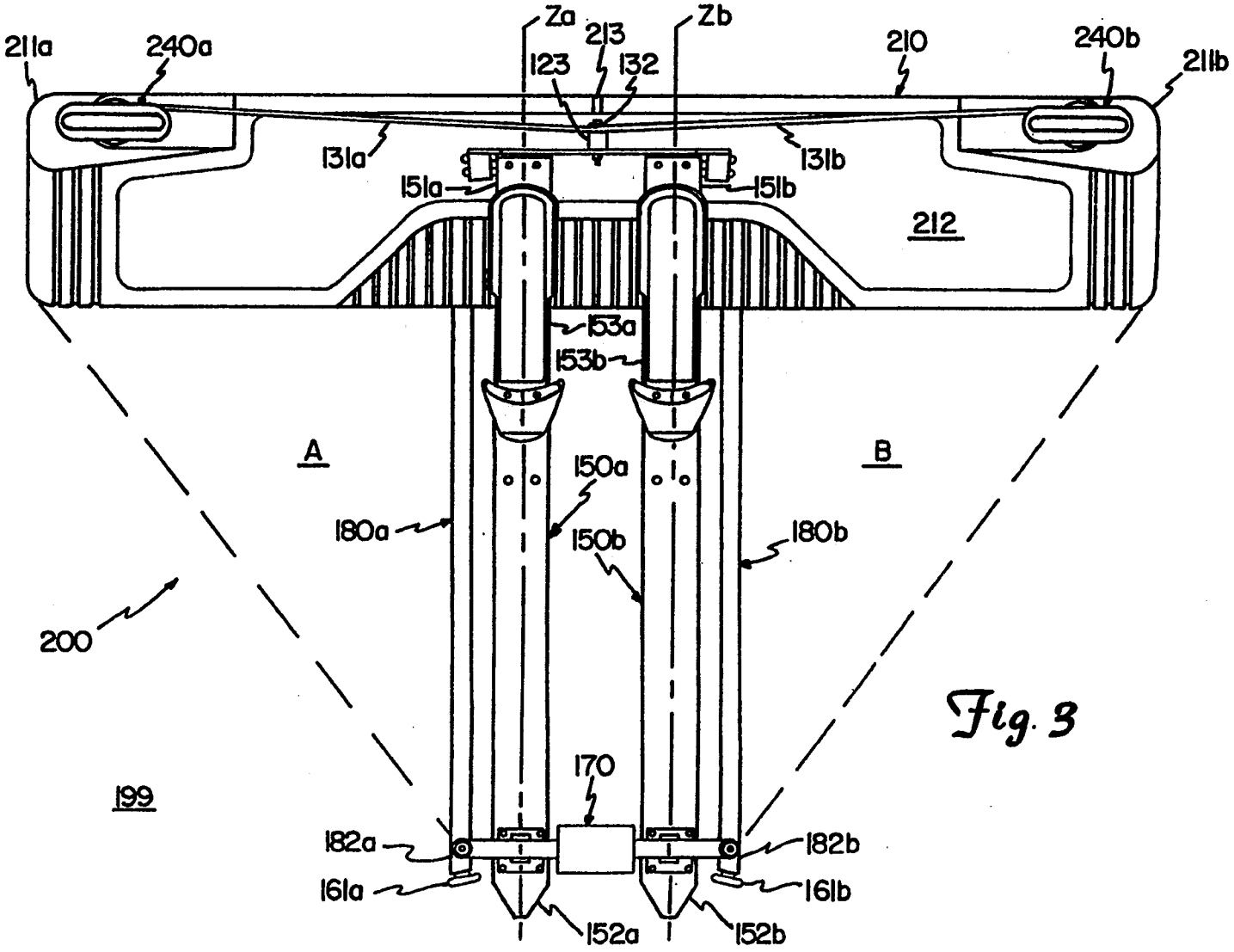
FIG. 3 is a top view of the exercise apparatus shown in FIG. 2.

As shown in FIGS. 2 and 3, the first elastic band segment **131*a* extends between the spacer 123 and the first band support 240*a*, which is proximate the first end 211*a* of the base 210. The second elastic band segment 131*b* extends between the spacer 123 and the second band support 240*b*, which is proximate the second end 211*b* of the base 210. The band supports 240*a* and 240*b* include selectively rotatable spools 241*a* and 241*b* that are selectively biased against rotation relative to the base 210. The spools 241*a* and 241*b* have star-shaped cross sections that mate with corresponding star-shaped recesses in the base 210. The elastic band segments 131*a* and 131*b* are secured relative to the spools 241*a* and 241*b*, respectively, to provide a means for urging the rear ski support 120 upward (toward the central location) on the track surface 212**. Alternatively, an elastic band could be wrapped around a single intermediate spool and fixed at each end to the ends of the base. Also, a series of openings may be punched in the elastic band along its length to provide a means for reducing the risk of complete severing of the elastic band during one tensioning cycle.

If the rear ski support 120 is displaced toward the first end **211*a*, then the tension in the first elastic band segment 131*a* decreases and the tension in the second elastic band segment 131*b* increases. The resulting tension imbalance urges the rear ski support 120 back toward the second end 211***b*. Similarly, in response to a displacement of the rear ski support 120 toward the second end 211*b*, an opposite resulting tension imbalance urges the rear ski support 120 back toward the first end 211*a*. Flanges 244*a* and 244*b* on the spools 241*a* and 241*b* serve as guide means for guiding a slack elastic band segment onto its respective spool.

The band supports 240*a* and 240*b* further include handles 243*a* and 243*b*, respectively, secured relative to their respective spools 241*a* and 241*b*. A person pulls up on a handle to remove the star-shaped cross section from the corresponding star-shaped recess, thereby making the spool rotatable. The "freed" handle is then turned to capture or release elastic band relative to the spool, and thereby increase or decrease the tension in a respective elastic band segment. When a tension adjustment is completed, the spool is returned to its rotation-locked position by pushing the star-shaped cross-section into the corresponding star-shaped recess. The relative tension in the first and second elastic band segments 131*a* and 131*b* can be determined from the relative alignment of the spacer 123 to the marker 213. Recognizing that the elastic band segments exert opposing tension forces on the rear ski support, any disparity in tension will cause the rear ski support to move off center in the direction of the "tenser" band. In this regard, the marker 213 serves as an indicator means for indicating relative tension in the elastic band segments. Similarly, the combination of the marker 213 and the handles 243*a* and 243*b* serves as a balance means for balancing the tensions in the elastic band segments. With the alternative embodiment having a single intermediate spool, indicating means and balancing means would be unnecessary because the tensions in the band segments would not be independently adjustable.

Alternatively, the relative tension could be determined by the relative orientation of the handles, where the same effective length of elastic band is provided on each side of the spacer 123, and the elastic band segments are wound in the same rotational direction about their respective spools. In such a case, the handles 243*a* and 243*b* would provide not only separate tension adjustment means for each spool 241*a* and 241*b*, but also separate indicator means for indicating relative tension adjustments in the first and second elastic band segments. Were the elastic band segments wrapped in the same rotational direction about their respective band supports, rotation of either spool in a first rotational direction would increase tension in a respective elastic band segment, and rotation of either spool in a second, opposite rotational direction would decrease tension in a respective elastic band segment.

The simulator skis 150*a* and 150*b* extend from rear ski ends 151*a* and 151*b* to front ski ends 152*a* and 152*b*. The longitudinal axes Za and Zb of the skis 150*a* and 150*b* define an angle of approximately 7 degrees relative to the floor surface 199. However, the skis 150*a* and 150*b* may be said to be approximately parallel to the floor surface 199 where "approximately parallel" is defined to mean "within 15 degrees of parallel." The rear ski ends 151*a* and 151*b* are pivotally mounted to (and supported by) the rear ski support 120. The plane of pivoting of the rear ski ends is substantially co-planar with the plane of rotation of the rear rollers to avoid the exertion of any significant moment force on the rear ski support. The rear ski ends 151*a* and 151*b* pivot about respective rear pivoting axes Xa and Xb that are above the skis 150*a* and 150*b* and approximately parallel to the floor surface 199.

The front ski ends 152*a* and 152*b* are pivotally mounted to (and supported by) the front ski support 160, and pivot about respective front pivoting axes Ya and Yb that are above the skis 150*a* and 150*b* and approximately parallel to the floor surface 199. The location of the pivoting axes above the skis provides natural stability and natural edging capability, as the skis naturally tend to orient their load bearing surfaces to capture their load. In other words, the most stable orientation for the skis 150*a* and 150*b* is directly in front of the load forces they are opposing, which is the least stable orientation for prior art skis that have their pivoting axes below the skis. Whether the load forces are simply the person's weight or some combination of weight and sideways thrust, the skis of the present invention tend to pivot to capture the load forces (perpendicularly) against their load bearing surfaces, whereas the prior art simulator skis tend to pivot to release the load forces (tangentially) relative to their load bearing surfaces.

The rear pivoting axes Xa and Xb are located farther above the skis than are the front pivoting axes Ya and Yb. The separate front and rear pivot radii provide an inclined pivot axis relative to the plane of the skis. As the simulator skis edge, the rear ski support tends to steer itself in a curve having an effective center beyond the front ski support 160.

As shown in FIG. 3, the skis 150*a* and 150*b* include foot supports 153*a* and 153*b* selectively mounted in one of a plurality of positions along skis 150*a* and 150*b*, respectively. The skis 150*a* and 150*b* have respective series of holes 154*a* and 154*b* formed therein, and the foot supports 153*a* and 153*b* have respective pegs (not shown for ski 150*a* but identical to that shown at 155*b* in FIG. 4 for ski 150*b*) that are sized and arranged to mate with various combinations of holes in the skis. The variable positioning of the foot supports provides capability to simulate a range of downhill skiing styles ranging from slalom (with foot supports rearward) to mogul (with foot supports forward).

The front ski support 160 is carried by front rollers 161*a* and 161*b*, which are in contact with the floor surface 199. A plastic mat can be placed under the front rollers to improve operation on irregular floor surfaces, such as carpet. The front ski support 160 is fitted with inertia sensory and data output means 170 for sensing when a person reverses direction on the skis, generating reversal data, and outputting the reversal data to a person using the apparatus. Those skilled in the art will recognize that an inertia switch is the means 170 may be a mercury switch or a mechanical inertia switch.

Bars 180*a* and 180*b* are disposed on opposite sides of the pair of skis 150*a* and 150*b*. The bars 180*a* and 180*b* extend between rear bar ends 181*a* and 181*b* that are pivotally secured to the base 110, and front bar ends 182*a* and 182*b* that are pivotally secured to the front ski support 160. The front bar ends 182*a* and 182*b* are pivotally secured to opposite sides of the front ski support 160 and are supported by front rollers 161*a* and 161*b*, respectively. The front rollers 161*a* and 161*b* have rotational axes directed toward respective rear bar end pivot points at the base 110, and the front rollers roll in arcs centered about these pivot points.

The pivoting axes of the front and rear bar ends are substantially perpendicular to the floor surface 199 and thus, are also substantially perpendicular to the pivoting axes of the front and rear ski ends, where "substantially perpendicular" is defined to mean "within 15 degrees of perpendicular." The rear bar ends 181*a* and 181*b* are spaced farther apart than the front bar ends 182*a* and 182*b*. Thus, reference lines drawn through respective rear and front bar ends converge at an effective center point beyond the front ski support. Also, the bars 180*a* and 180*b* include rearward segments 183*a* and 183*b* and forward segments 184*a* and 184*b*, respectively, and the forward segments 184*a* and 184*b* are relatively less convergent (more parallel) than the rearward segments 183*a* and 183*b*. In another embodiment, the bars include first segments that converge from the rear bar end pivot points to rear hidden points beneath the skis, second segments that extend substantially parallel beneath the skis from the rear hidden points to front hidden points, and third segments that diverge from the front hidden points to the front bar end pivot points. As shown in FIG. 3, the relatively parallel nature of the forward segments 184*a* and 184*b* leaves a great deal of space (designated at A and B) for the simulator ski poles 190*a* and 190*b* to engage the floor surface 199. This ski pole space is maximized in the embodiment having the bars disposed beneath the skis.

Those skilled in the art will recognize that the bars 180*a* and 180*b* are non-parallel, equal length sides of a four bar linkage that also includes the base 110 and the front ski support 160. As such, the base (or rear bar) 110, the bars 180*a* and 180*b*, and the front ski support (or front bar) 160 define a frame that supports the skis 150*a* and 150*b*. The skis 150*a* and 150*b* are substantially perpendicular to the front bar 160, and when in a rest position the skis are also perpendicular to the rear bar 110. In operation, the four bar linkage provides a realistic downhill skiing motion having both rotational and translational components.

While the present invention has been described in terms of a preferred embodiment, those skilled in the art will recognize a variety of embodiments that differ from the preferred embodiment but still remain within the scope of the present invention. Accordingly, the present invention is to be limited only by the appended claims.

What is claimed is:

1. An exercise apparatus designed to rest upon a floor surface, comprising a base that supports a track surface above the floor surface, a pair of skis that extend from rear ski ends to front ski ends, wherein each rear ski end is supported by a rear ski support which is carried by at least one rear roller that engages the track surface, and each front ski end is supported by a front ski support which is carried by at least one front roller that engages the floor surface, and a first elastic band segment extends between the rear ski support and a first band support proximate a first end of the base, and a second elastic band segment extends between the rear ski support and a second band support proximate a second, opposite end of the base.

2. An exercise apparatus according to claim 1, further comprising a spacer secured to the rear ski support, wherein the elastic band segments are secured to the spacer to decrease the likelihood of contact between the elastic band segments and the rear ski support.

3. An exercise apparatus according to claim 1, wherein each band support includes a selectively rotatable spool that is selectively biased against rotation, and each elastic band segment is secured relative to a respective spool.

4. An exercise apparatus according to claim 3, further comprising a separate adjustment means for each spool, for adjusting tension in a respective elastic band segment.

5. An exercise apparatus according to claim 4, further comprising indicator means for indicating relative tension in the first and second elastic band segments.

6. An exercise apparatus according to claim 1, further comprising balance means for balancing tension in the first and second elastic band segments.

7. An exercise apparatus according to claim 3, further comprising a separate handle for each spool, wherein a person pulls up on the handle to unbias the spool and then turns the handle to rotate the spool and adjust tension in a respective elastic band segment.

8. An exercise apparatus according to claim 1, wherein the first and second elastic band segments are portions of a single elastic band extending between the first and second band supports and secured at an intermediate region to the rear ski support.

9. An exercise apparatus according to claim 1, wherein each rear ski end is pivotally mounted to the rear ski support to pivot about a respective rear pivoting axis located above the ski, and each front ski end is pivotally mounted to the front ski support to pivot about a respective front pivoting axis located above the ski.

10. An exercise apparatus according to claim 9, wherein the rear pivoting axes are located farther above the skis than are the front pivoting axes.

11. An exercise apparatus according to claim 9, wherein the rear ski ends define a pivoting plane that is substantially co-planar with a rotation plane defined by the at least one roller.

12. An exercise apparatus designed to rest upon a floor surface, comprising a base that supports a track surface above the floor surface, a pair of skis that extend from rear ski ends to front ski ends, wherein each rear ski end is supported by a rear ski support which is carried by at least one rear roller that engages the track surface, and each front ski end is supported by a front ski support which is carried by at least one front roller that engages the floor surface, and a pair of bars disposed on opposite sides of the pair of skis and extending between rear bar ends that are pivotally secured to the base, and front bar ends that are pivotally secured to opposite sides of the front ski support.

13. An exercise apparatus according to claim 12, wherein each front bar end is supported by a front roller having a rotational axis directed toward a respective rear bar end pivot point.

14. An exercise apparatus according to claim 13, wherein the rear bar ends are spaced farther apart than the front bar ends, and the bars include forward segments and rearward segments, and the forward segments are relatively less convergent than the rearward segments.

15. An exercise apparatus according to claim 1, further comprising guide means for guiding the elastic band segments relative to the elastic band supports.

16. A downhill skiing simulator having a frame, a pair of simulator skis extending from a rear portion of the frame to a front portion of the frame, wherein the frame includes a pair of bars disposed on opposite sides of the skis and having respective rear bar ends pivotally mounted to said rear portion of the frame, and respective front bar ends pivotally mounted to opposite sides of said front portion of the frame and each supported by a front roller.

17. A downhill skiing simulator according to claim 16, wherein each front roller has a rotational axis directed toward a respective rear bar end pivot point.

18. A downhill skiing simulator according to claim 16, wherein said rear bar ends are spaced farther apart than said front bar ends.

19. An exercise apparatus according to claim 16, wherein said bars include forward segments and rearward segments, and said forward segments are relatively less convergent than said rearward segments.

20. An exercise apparatus according to claim 18, wherein said bars include forward segments and rearward segments, and said forward segments are relatively less convergent than said rearward segments, whereby the bars provide a desired pivoting action without excessively interfering with floor space necessary for operation of simulator ski poles.

21. A downhill skiing simulator, comprising a pair of simulator skis having ski front ends and ski rear ends, a front bar that supports said ski front ends, a rear bar that supports said ski rear ends, and a pair of non-parallel, equal length side bars having bar front ends and bar rear ends, wherein said side bars are disposed on opposite sides of said pair of simulator skis, and said bar front ends are pivotally connected to said front bar, and said bar rear ends are pivotally connected to said rear bar, and said front bar is free to move relative to said rear bar along a path determined by said side bars.

22. A downhill skiing simulator according to claim 21, wherein said skis remain substantially perpendicular to said front bar as said front bar moves relative to said rear bar.

23. A downhill skiing simulator according to claim 21, wherein said front bar is supported above a floor surface by at least one roller in contact with said floor surface.

24. A downhill skiing simulator according to claim 21, wherein said ski rear ends are supported by a rear ski support in rolling contact with a surface on said rear bar.

25. A downhill skiing simulator according to claim 24, wherein said skis remain substantially perpendicular to said rear ski support as said front bar moves relative to said rear bar.

* * * * *